United States Patent [19]

Quitadama

[11] 4,256,013

[45] Mar. 17, 1981

[54] MULTIPLE TARGET WEAPONS SYSTEM

[76] Inventor: Dominick J. Quitadama, 490 Forest Ave., Paramus, N.J. 07652

[21] Appl. No.: 25,680

[22] Filed: Mar. 30, 1979

[51] Int. Cl.[3] ..... F41C 19/12

[52] U.S. Cl. ..... 89/41 TV; 42/84; 89/136

[58] Field of Search ..... 42/84; 89/41 TV, 135, 89/136

[56] References Cited

U.S. PATENT DOCUMENTS 2,359,032 9/1944 Gott ..... 89/41 TV 2,990,471 6/1961 Tiffany ..... 42/71 R 3,703,845 11/1972 Griew ..... 89/135

FOREIGN PATENT DOCUMENTS 2308897 11/1976 France ..... 42/84

*Primary Examiner*—Stephen C. Bentley

*Attorney, Agent, or Firm*—Samuelson & Jacob

[57] ABSTRACT

A weapon system in which a plurality of guns, each capable of being aimed at a different selected one of a corresponding plurality of targets, are fired only when all are on target, whereby the plurality of guns will be fired simultaneously at the plurality of targets.

13 Claims, 8 Drawing Figures

MULTIPLE TARGET WEAPONS SYSTEM

The present invention relates generally to weapons systems and pertains, more specifically, to a weapons system in which a plurality of weapons are fired simultaneously at a corresponding plurality of targets, with each weapon aimed at a different selected one of the plurality of targets.

In many instances where it becomes necessary to deploy a plurality of weapons for firing at a plurality of targets, it would be advantageous to have available a system in which the weapons are controlled so that all of the targets are fired at simultaneously. For example, in hunting down a small pack of wild animals it would be most expedient to have a team of riflemen with each member of the team assigned to aim his rifle at a different animal in the pack and a control system for assuring that all of the rifles are fired simultaneously when each is aimed at the assigned animal so that all of the animals are disabled before they have an opportunity to disperse, as they might if fired at at random. Likewise, in dealing with a group of armed robbers or a group of terrorists some of whom may be threatening devastating destruction or the lives of hostages, it would be advantageous to deploy a team of marksmen who could fire their weapons simultaneously at all of the members of the group so that no one member of the group will have the opportunity to act adversely in response to firing upon other members of the group. In this manner, the group will be disabled expeditiously and with relative safety.

It is therefore an object of the invention to provide a weapons system in which a plurality of weapons are aimed individually at each of a corresponding plurality of targets and fired simultaneously only when all of the weapons are on target.

Another object of the invention is to provide a weapons system in which individual operators man individual weapons which are interconnected through a control system enabling firing of all of the weapons simultaneously when each weapon is on target.

Still another object of the invention is to provide a weapons system of the type described and in which a communications system links together the individual operators so that each operator may select a different target from among a plurality of targets and communicate his selection to the other operators to assure that all targets are covered.

Yet another object of the invention is to provide a weapons system of the type described and in which each operator is given a prescribed timed interval to prepare for the remote controlled firing of his weapon once all of the weapons are on target, with the timed interval being visually indicated to the operator.

A further object of the invention is to provide a weapons system of the type described and in which a master controller can monitor the system and assure that the weapons are fired only when on target and only when all of the targets are covered.

A still further object of the invention is to provide a weapons system which is effective against a plurality of targets, such as a group of terrorists, a gang of armed robbers, or a pack of wild animals, to neutralize expeditiously the dangers posed by individual actions of the members of the group, gang or pack.

The above objects, as well as still further objects and advantages, are attained by the present invention which may be described briefly as a weapons system for firing simultaneously at every one of a plurality of targets, the weapons system comprising: a plurality of guns each capable of being aimed, by an operator associated with each gun, at a different selected one of a corresponding plurality of targets; fire-ready means in each gun for operation by the associated operator to place each gun in fire-ready condition when that particular gun is aimed at the corresponding selected target; firing means in each gun for firing that gun; and control means associated with all of the guns for actuating every firing means simultaneously in response to the placement of every gun in fire-ready condition, whereby the plurality of guns will be fired simultaneously at the plurality of targets.

The invention will be more fully understood, while still further objects and advantages will become apparent, in the following detailed description of preferred embodiments of the invention illustrated in the accompanying drawing, in which.

Figure 1:
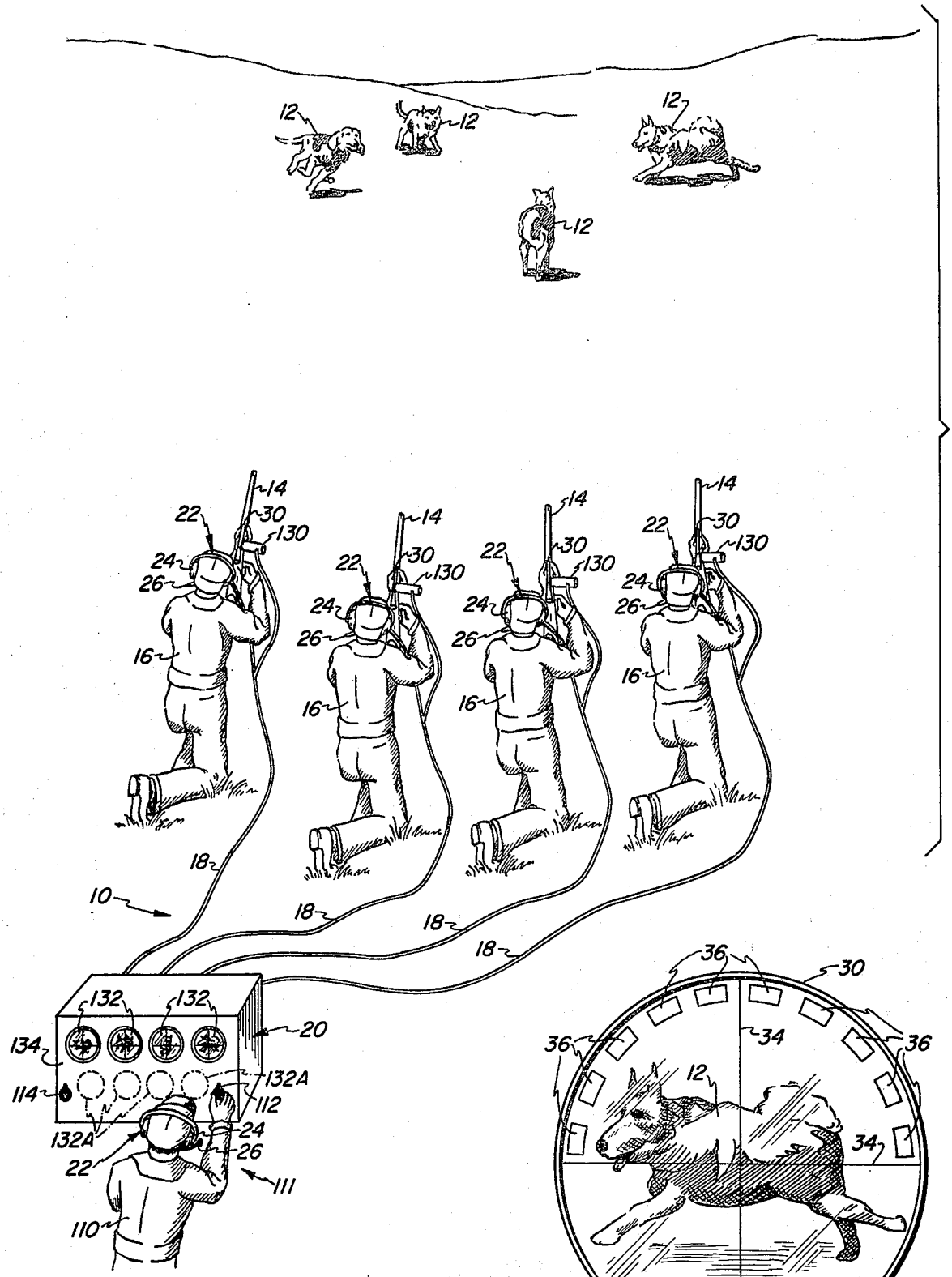
FIG. 1 is a pictorial view illustrating a weapons system constructed in accordance with the invention and in use in the field.

Referring now to the drawing, and especially to FIG. 1 thereof, a weapons system constructed in accordance with the invention is illustrated at 10 and is seen deployed in the field to eliminate a pack of wild dogs 12. While the illustrated embodiment is shown combating a pack of wild dogs 12, it is to be understood that weapons system 10 is equally effective in dealing with other groups of targets such as a gang of armed robbers or a group of terrorists.

Weapons system 10 includes a plurality of guns shown in the form of rifles 14, each held by an operator shown as a rifleman 16. Since the number of targets (dogs 12) is four, there are four rifles 14 and four riflemen 16. Each rifle 14 is connected, by means of an electrical cable 18, to a central master control unit 20.

Riflemen 16 are deployed after having been assigned a particular selected target at which each is to aim his rifle. Alternately, each riflemen 16 is provided with a headset 22, having earphones 24 and a microphone 26, the headsets 22 being interconnected through cables 18 to provide communications means enabling the riflemen 16 to advise one another of each target selection so that each rifleman is assured that he is aiming at a dog 12 different from the dogs 12 being aimed at by the other riflemen 16. In this manner all of the dogs 12 will be aimed at.

Figure 2:
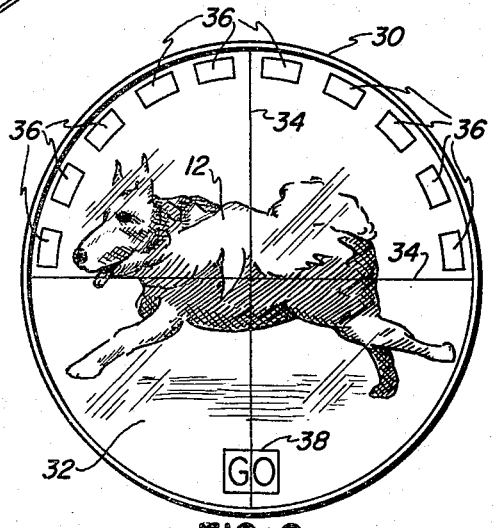
FIG. 2 is an illustration of a target as seen through the sight of a rifle of the weapons system.

Rifles 14 preferably are high-powered rifles, each provided with a scope sight 30. As seen in FIG. 2, each sight 30 provides a corresponding rifleman 16 with an enlarged field of view 32 within which there is placed standard crosshairs 34. In addition, each sight 30 displays a series of count-down indicators in the form of lights 36 extending along a portion of the perimeter of the field of view 32. A further signal light 38 is placed at another location in the field of view 32, for purposes which will be explained below.

Figure 3:
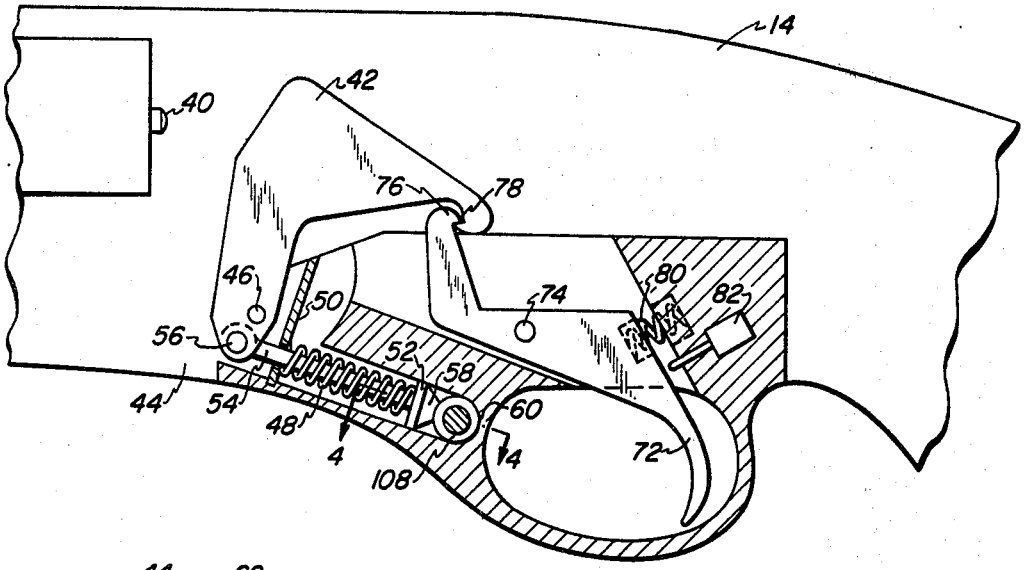
FIG. 3 is a fragmentary cross-sectional view of a rifle of the weapons system.
Figure 4:
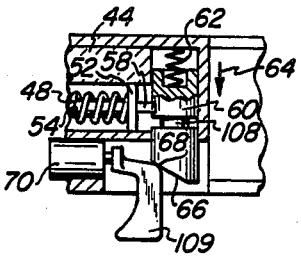
FIG. 4 is a fragmentary cross-sectional view taken along line 4—4 of FIG. 3.

Turning now to FIGS. 3 and 4, each rifle 14 has a firing means which includes a firing pin 40 to be struck by a hammer 42 mounted for pivotal movement on the frame 44 of the rifle 14 at pivot pin 46. In the cocked position, as seen in FIG. 3, the hammer 42 is biased in a counterclockwise direction by a helical spring 48 which extends between a wall 50 on frame 44 and a collar 52, which is integral with a rod 54 secured to the hammer at 56. Rod 54 carries a finger 58 which rests against a spindle 60, as seen in FIGS. 3 and 4, to retain the hammer 42 in the cocked position. Spindle 60 is mounted for sliding movement laterally within frame 44 and is biased into the position shown in FIG. 4 by means of a spring 62 which urges the spindle 60 laterally, in the direction of arrow 64. A cam follower face 66 of the spindle 60 rests against a cam 68 carried by the armature of a solenoid 70, which serves as an electrically operated actuator for purposes which will be more fully described hereinafter.

A fire-ready means includes an actuator in the form of a trigger 72 pivoted upon frame 44 at 74 and having a tooth 76 which engages a complementary shoulder 78 on the hammer 42 to lock the hammer 42 in the cocked position and retain the rifle 14 in a non-firing condition. Trigger 72 is biased toward the rest position, illustrated in FIG. 3, by a return spring 80.

Figure 5:
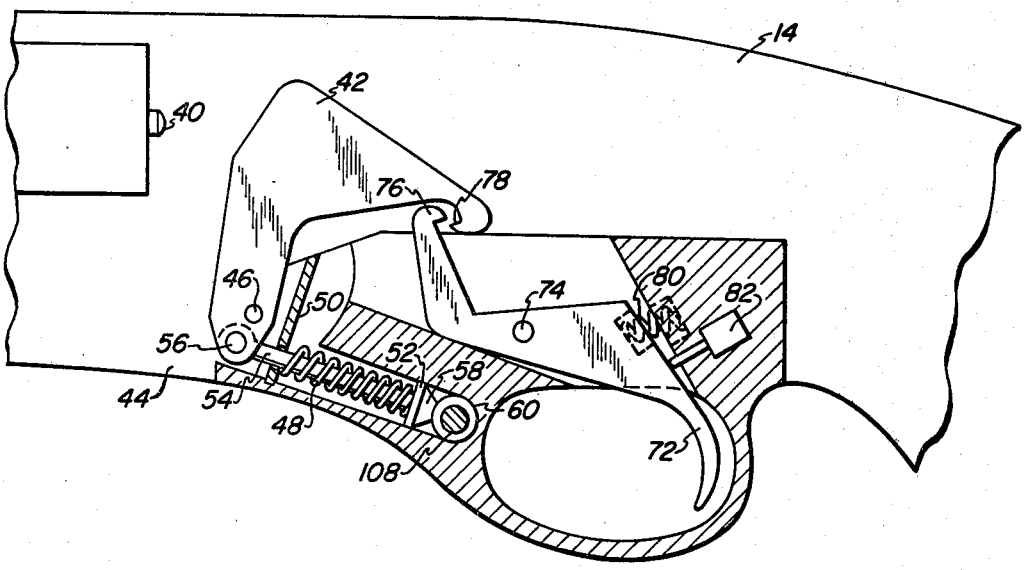
FIG. 5 is a view similar to FIG. 3, but with component parts in a different operating position.

Referring now to FIG. 5, as well as to FIGS. 1 through 4, when a rifle 14 is aimed at a selected dog 12, the rifleman 16 will depress the trigger 72 of his rifle 14 to move the trigger 72 to the depressed position illustrated in FIG. 5. Such movement of the trigger 72 will release the shoulder 78 of the hammer 42 from the tooth 76 of the trigger 72, thereby placing the firing means of the rifle 14 in a fire-ready condition, wherein the hammer 42 is no longer locked by the trigger 72, but is precluded from movement by virtue of the finger 58 resting against spindle 60. At the same time, trigger 72, actuates a switch 82 for purposes which now will be described in detail.

Figure 6:
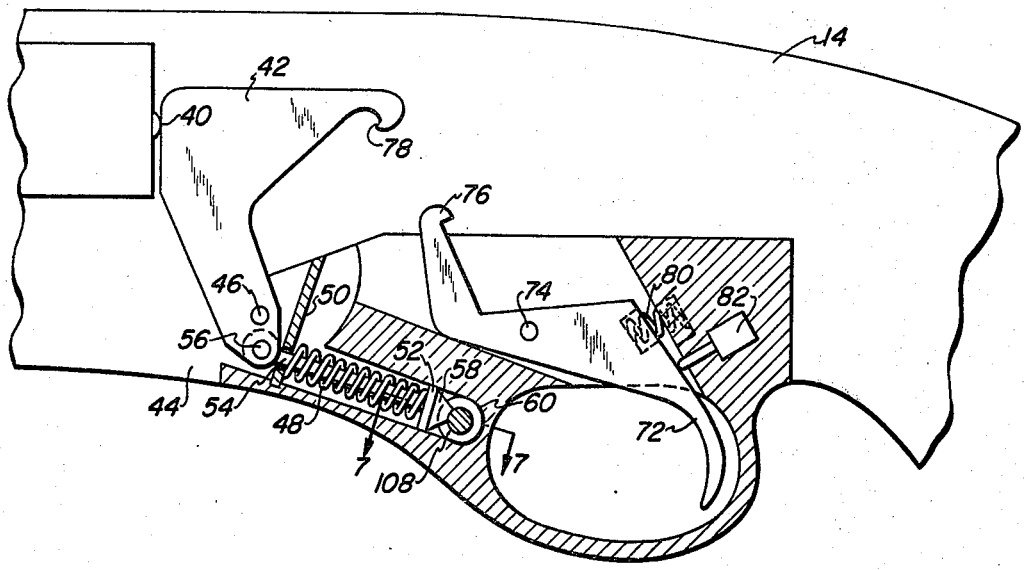
FIG. 6 is another view similar to FIG. 3, but with the component parts in a still different operating position.
Figure 7:
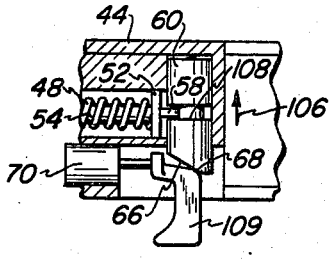
FIG. 7 is a fragmentary cross-sectional view taken along line 7—7 of FIG. 6.
Figure 8:
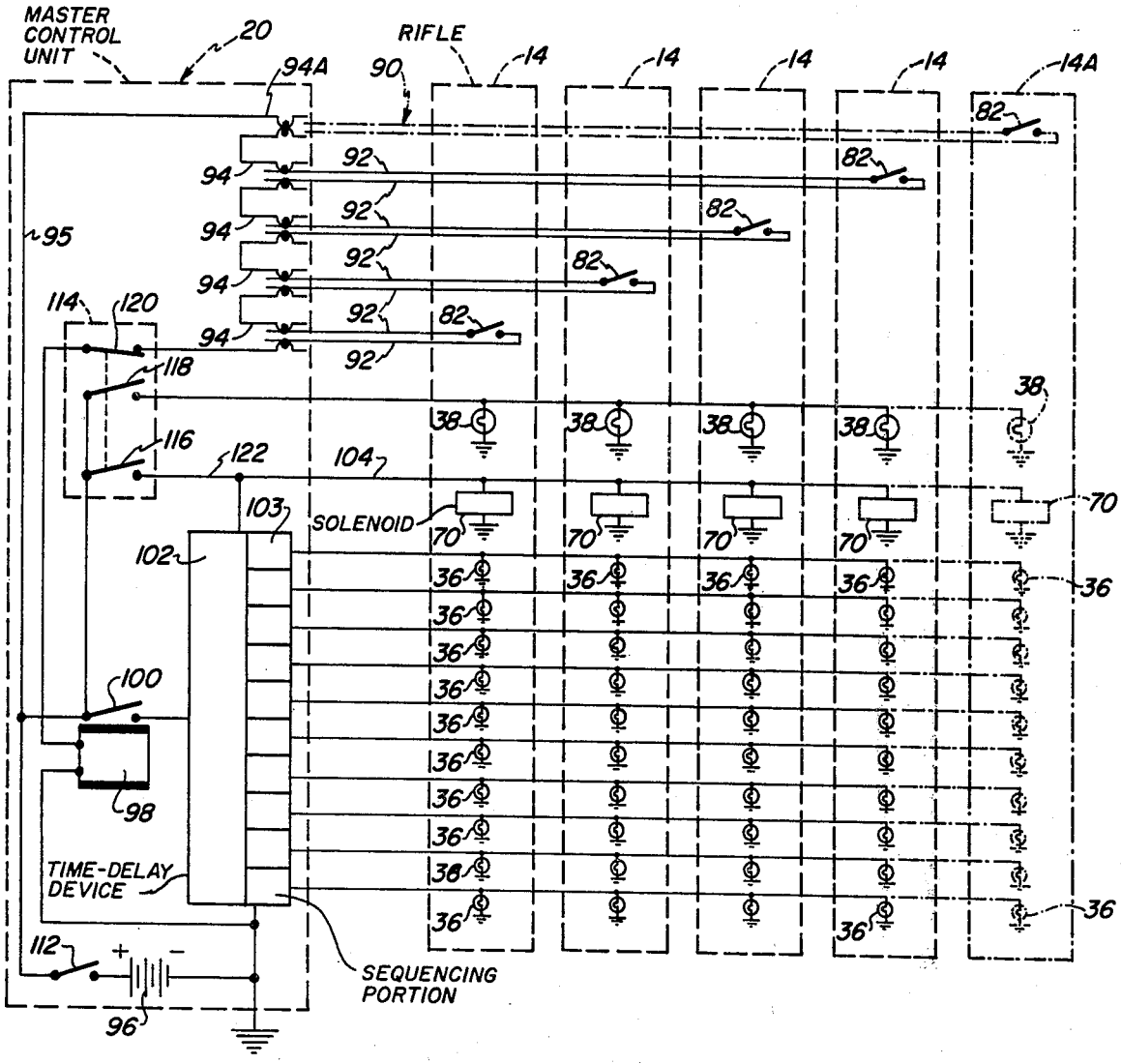
FIG. 8 is a largely schematic diagram of the control arrangement of the weapons system.

Turning to FIGS. 6 through 8, as well as to FIGS. 1 through 5, when all of the rifles 14 are aimed at their respective targets, and all of the triggers 72 are held depressed by all of the riflemen 16, thereby placing all of the rifles in fire-ready condition, the master control unit 20 will actuate every firing means simultaneously so that all of the rifles will be fired at the same time.

Simultaneous actuation of the firing means in all of the rifles 14 is accomplished by a control arrangement depicted schematically at 90 in FIG. 8. Thus, each switch 82 is connected, through conductors 92 in cables 18 and connectors 94 in master control unit 20, in a series circuit 95 with a source 96 of electrical power and a relay 98. When all of the switches 82 are closed, by holding all of the triggers 72 in the depressed position, relay 98 is actuated to close the relay contacts 100 and deliver electrical current to a time-delay device 102. The time-delay device 102 will provide a prescribed, relatively short interval of time during which the count-down lights 36 in each scope sight 30 will light, with a sequencing portion 103 of the time-delay device 102 serving to light the count-down lights 36 in sequence to indicate to every rifleman when all of the rifles are in fire-ready condition and the precise time remaining before the rifles 14 will fire. In this manner, each rifleman 16 can brace himself in anticipation of the exact moment of firing. In the illustrated embodiment, the duration of the interval of time between the closing of relay contacts 100 and the firing of rifles 14 is about three to five seconds and the number of lights 36 is ten. Thus, each riflemen 16 will know that after the ninth light 36 is illuminated and before illumination of the tenth light 36 only a split-second remains before firing. In an alternate arrangement, all of the count-down lights 36 would be illuminated immediately upon placement of all of the rifles 14 in fire-ready condition and the sequencing portion 103 of time-delay device 102 would extinguish each light 36, in sequence, during the timed interval so that each rifleman 16 will know that upon illumination of all of the lights 36 only a few seconds remain before firing and that firing will take place when the last of the lights 36 is extinguished.

At the end of the timed interval, the time-delay device 102 will activate control circuit 104 to actuate every solenoid 70 simultaneously. Actuation of each solenoid 70 will drive cam 68 to the right, as seen in FIG. 7, so that cam 68 will move spindle 60 laterally, in the direction of arrow 106 in FIG. 7, against the biasing force of spring 62. Such movement of the spindle 60 will align groove 108 of the spindle 60 with finger 58 on rod 54 enabling the finger 58 to enter groove 108 under the influence of spring 48. Movement of the finger 58 entails corresponding movement of rod 54 and concomitant movement of hammer 42 against the firing pin 40, as seen in FIG. 6. Thus, every rifle 14 will fire at the same time, in response to every rifle being placed in a fire-ready condition.

Should any rifleman 16 decide at any time that his rifle 14 is not properly aimed, he need merely release the trigger 72 of his rifle 14, thereby enabling the return spring 80 to return the trigger 72 to the rest position and opening the switch 82 in his rifle. The opening of any switch 82 will interrupt the series circuit 95 to the relay 98 and will either preclude closing of the relay contacts 100 or will open the relay contacts 100 to discontinue the count-down and preclude the energization of control circuit 104.

While in the illustrated embodiment only four rifles 14 are shown, additional rifles may be employed as required. Thus, the schematic illustration of FIG. 8 depicts an optional additional rifle 14A, shown in phantom, and any mumber of such additional rifles may be incorporated in the weapons system. It is noted that connectors 94 are of the type which are closed when unconnected, as illustrated at 94A, so that any number of connectors 94 may be placed in the master control unit 20 without interruption of the series circuit 95 should no connection be made to any particular connector.

If it becomes necessary to convert any or all of the rifles 14 to a manual firing mode, such conversion is accomplished readily by operating lever 109 (see FIGS. 4 and 7) which is integral with cam 68 and which projects beyond the frame 44 of the rifle 14 to enable the rifleman 16 to grasp lever 106 and manually draw the lever 109 and cam 68 into the position shown in FIG. 7, thereby enabling firing of the rifle 14 in a conventional manner.

As an optional additional feature of the weapons system 10, the master control unit 20 can be monitored by a master control monitor operator designated as a team captain 110, as shown in FIG. 1. The team captain 110 is provided with a further headset 22 so that he is able to listen to and communicate with the riflemen 16 from a master control monitor station 111. Since the team captain 110 can view the entire operation from the overall viewpoint available from station 111, he can best determine how the operation should progress.

By providing the master control unit 20 with further controls which can be operated by the team captain 110, the weapons system 10 is made more flexible. Thus, a master control switch 112 (also see FIG. 8) can be opened at anytime by the team captain 110, should the team captain 110 determine that automatic simultaneous firing of the rifles 14 is undersirable for any reason. The opening of switch 112 will open series circuit 95 and preclude actuation of relay 98.

Should the team captain 110 decide that it would be appropriate for the individual rifles 14 to be fired at will by riflemen 16, rather than automatically under the remote control of the master control unit 20, the team captain 110 can actuate a switch 114. Switch 114 actually includes three switch legs 116, 118 and 120. Switch leg 120 is closed when switch legs 116 and 118 are open, but is open when switch legs 116 and 118 are closed. In the position of switch 114 illustrated in FIG. 8, weapons system 10 is in the automatic control mode, with the series circuit 95 closed through switch legs 120. However, should the team captain 110 actuate switch 114 to the manual firing mode, switch leg 120 will be opened while switch legs 116 and 118 are closed. Thus, all of the solenoids 70 will be actuated, through circuit 122, to move the corresponding spindles 60 to the enabling position, shown in FIG. 7, allowing firing of the rifles 14 at will. At the same time, the further signal lights 38 will be illuminated to indicate to each rifleman 16 that his rifle 14 is in the manual mode and that he can fire at will. Alternately, the team captain 110 may be provided with separate switches (not shown) for selectively actuating each solenoid 70 (and each corresponding signal light 38) separately so that the team captain can select only certain riflemen 16 for firing at will, while other riflemen will be unable to fire at will.

As a further optional feature of the weapons system 10, each scope sight 30 may be provided with a television camera 130 suitably coupled to the scope sight 30 for transmitting a television picture of the field of view 32 to the master control unit 20. The master control unit 20 would then include a separate television monitor display 132 for the field of view 32 of each rifle 14 so that the team captain 110 visually can determine if all of the rifles 14 are aimed properly at all of the targets. As seen in FIG. 1, monitor displays 132 are arranged in a terminal 134 at station 111, there being provided added facilities for further monitor displays at 132A. The ability of the team captain to monitor visually the aiming of all of the rifles 14, together with the ability of the team captain 110 to view the entire scene from an overall viewpoint provides exceptional control and added safety in the operation of the weapons system 10.

It is to be understood that the above detailed description of embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. A weapons system for firing simultaneously at every one of a plurality of targets, said weapons system comprising:

a plurality of guns each capable of being aimed, by an operator associated with each gun, at a different selected one of a corresponding plurality of targets;

fire-ready means in each gun for operation by the associated operator to place each gun in fire-ready condition when that particular gun is aimed at the corresponding selected target;

indicating means associated with each gun for indicating to the operator of that gun when every gun is in fire-ready condition;

firing means in each gun for firing that gun; and control means associated with all of the guns for actuating every firing means simultaneously in response to the placement of every gun in fire-ready condition, whereby the plurality of guns will be fired simultaneously at the plurality of targets.

2. The invention of claim 1 wherein the fire-ready means includes a trigger capable of operation between a rest position, wherein the gun is in a non-firing condition, and an actuated position, wherein the gun is placed in a fire-ready condition, said trigger being selectively movable, by the operator, to either of the rest and actuated positions.

3. The invention of claim 2 wherein the control means includes an electrically operated actuator in each gun for enabling and disabling operation of the firing means in that gun, and electrical means for operating every actuator simultaneously to enable operation of the firing means in each gun in response to the placement of every gun in fire-ready condition.

4. The invention of claim 3 wherein the electrical means includes a control circuit for operating all of the actuators simultaneously and an electrical switch in each gun operated by the trigger of that gun, the electrical switches of all of the guns being connected in a series circuit coupled with the control circuit such that the control circuit is energized upon closing all of the switches in the series circuit and is deenergized upon opening any one of said switches.

5. The invention of claim 3 or 4 wherein the control means includes a master control switch for selectively disconnecting the electrical means and the actuators so as to preclude selectively the simultaneous operation of the actuators.

6. The invention of claim 5 wherein the control means includes a further control switch for selectively operating every actuator to enable operation of the firing means of each gun independent of the condition of the other guns.

7. The invention of claim 1 wherein the control means includes time-delay means for delaying simultaneous actuation of every firing means for a prescribed interval following the placement of all of the guns in fire-ready condition.

8. The invention of claim 7 including further indicating means in each gun for indicating to each operator the duration of the prescribed interval.

9. The invention of claim 8 wherein the further indicating means includes a series of visible indicators and means operating the visible indicators in sequence to provide a visible count-down of the duration of the prescribed interval.

10. The invention of claim 9 wherein the visible indicators are indicator lights.

11. The invention of claim 1 including a communication means for interconnection among the operators to enable each operator to communicate a target selection to the other operators.

12. The invention of claim 11 wherein the communication means includes a master control monitor station interconnected with the operators for enabling communication between a monitor operator and the other operators.

13. The invention of claim 12 wherein each gun includes a television camera for viewing the field at which the gun is aimed and the master control monitor station includes a television monitor display for each camera whereby the monitor operator may determine visually the target at which each gun is aimed.

* * * * *

UNITED STATES PATENT AND TRADEMARK OFFICE

CERTIFICATE OF CORRECTION

PATENT NO. : 4,256,013

DATED : March 17, 1981

INVENTOR(S) : Dominick J. Quitadamo

It is certified that error appears in the above—identified patent and that said Letters Patent is hereby corrected as shown below:

In the heading and in item [76] appearing on the title page of the patent, the inventor's name "Quitadama" should read -- Quitadamo --

Column 4, line 48, "mumber" should read -- number --

Column 5, line 13, "undersirable" should read -- undesirable--

Signed and Sealed this

*First* Day of *December 1981*

[SEAL]

*Attest:*

GERALD J. MOSSINGHOFF

*Attesting Officer* *Commissioner of Patents and Trademarks*